United States Patent [19]

Seeger et al.

[11] Patent Number: 4,705,922

[45] Date of Patent: Nov. 10, 1987

[54] RELAY FOR THE OPERATION OF A BELT TIGHTENER OR TENSIONER FOR AUTOMOBILE SAFETY BELTS

[75] Inventors: Gunter A. Seeger, Frittlingen; Arno Reger, Deilingen, both of Fed. Rep. of Germany

[73] Assignee: Hengstler Bauelemente GmbH, Fed. Rep. of Germany

[21] Appl. No.: 933,826

[22] Filed: Nov. 24, 1986

[30] Foreign Application Priority Data

Jun. 10, 1986 [DE] Fed. Rep. of Germany ..... 3619474

[51] Int. Cl.[4] ..... H01H 35/14

[52] U.S. Cl. ..... 200/61.45 M; 335/205

[58] Field of Search ..... 200/61.45 M, 81.9 M, 200/82 E; 335/205, 206, 207

[56] References Cited

U.S. PATENT DOCUMENTS 3,097,272 7/1963 Hautly ..... 200/61.45 M
4,081,635 3/1978 Moore ..... 200/82 E
4,484,041 11/1984 Andres et al. ..... 200/61.45 M
4,596,971 6/1986 Hirabayashi et al. ..... 335/205

FOREIGN PATENT DOCUMENTS 2206985 8/1973 Fed. Rep. of Germany ... 200/61.45 M

*Primary Examiner*—J. R. Scott

*Attorney, Agent, or Firm*—Nilsson, Robbins, Dalgarn, Berliner, Carson & Wurst

[57] ABSTRACT

A relay for the operation of a belt tightener or tensioner for automobile safety belts in the event of a collision with an obstacle. The relay consists of a conduit or dry-reed contact arrangement which is arranged in a housing with its longitudinal axis aligned perpendicular to the direction of travel and vertical to the horiztonal plane of the automobile, and an annular magnet surrounding the contact arrangement which is retained perpendicular to the longitudinal axis of the conduit of the contact arrangement by springs, equidistant from the contact arrangement at rest, and movable mainly horizontally.

24 Claims, 9 Drawing Figures

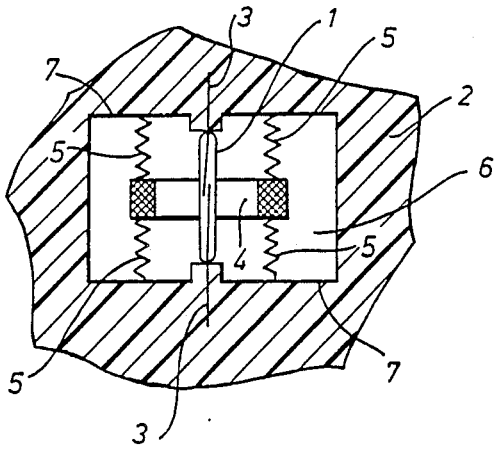
FIG 4
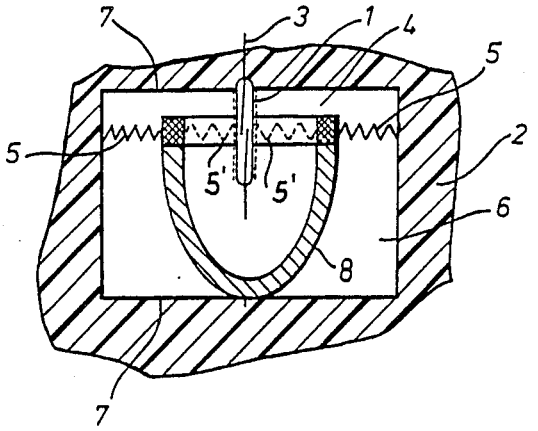
FIG 5
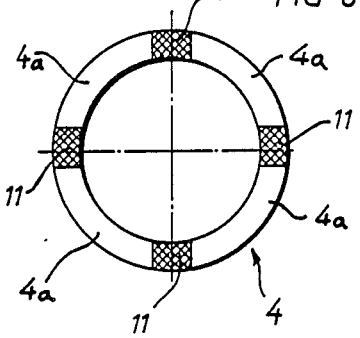
FIG 6
FIG 7
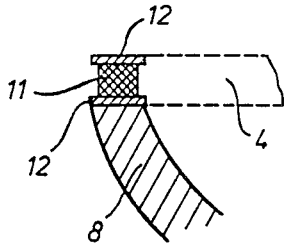

RELAY FOR THE OPERATION OF A BELT TIGHTENER OR TENSIONER FOR AUTOMOBILE SAFETY BELTS

BACKGROUND OF THE INVENTION

The invention relates to a relay for the operation of a belt tightener for automobile safety belts in event of a collision with an obstacle.

A relay arrangement in this field is known, which provides a known conduit or dry-reed contact arrangement for the switching initiated by an automobile collision, in which a permanent magnet, formed as a ring, is retained by springs. In the case of a collision with an obstacle, this permanent magnet is accelerated forwards along the longitudinal axis of the contact spring arrangement, against the spring pressure and this initiates the switching sequence for operation of the belt-tightener.

Such a relay must therefore be installed in an automobile in such a way that the conduit or dry-reed contact arrangement is aligned longitudinally with the longitudinal axis of the vehicle to be able to directly bring about the switching sequence in the event of a collision.

A disadvantage of this layout is that in the event of a stop initiated by a rear end collision from another automobile, a relay so installed does not operate due to the inertia of the annular magnet.

In order to be able to detect a collision shock from another automobile approaching from the rear and to initiate the corresponding switching sequence, an inversely spring-loaded second relay of this type would therefore have to be provided. Two such relays can therefore initiate a switching sequence in the event of both a frontal or rear-end collision when these shocks occur either in or close to the direction of the longitudinal axis of the vehicle.

BRIEF SUMMARY OF THE INVENTION

The present invention takes as its basis the technical problem of forming a relay for the operation of a belt tightener or tensioner for automobile safety belts in such a way that in the event of a frontal collision with an obstacle or a rear-end collision by another automobile, a single relay initiates the necessary and instantaneously required switching sequence.

Furthermore, the invention is based on a further technical problem namely that of forming the relay in such a way that shocks not occuring in or close to the direction of the longitudinal axis of the vehicle can also be detected by the relay to initiate the switching sequence. For. example, the shocks arising by the skidding of the automobile sideways into an obstacle or by being rammed in the side by another vehicle.

Specifically, to solve these problem situations such a relay is characterized by a conduit or dry-reed contact arrangement arranged in a housing. The longitudinal axis of the conduit or dry-reed arrangement is aligned perpendicular to the direction of travel of the vehicle and vertical to the horizontal plane of the vehicle. An annular magnet surrounding the contact arrangement is retained by springs to be perpendicular to the longitudinal axis of the conduit. The springs are positioned equidistant from the contact arrangement at rest, and the annular magnet is movable mainly horizontally.

This arrangement of the annular magnet equidistant about a reed-contact arrangement aligned vertically to the horizontal plane of the vehicle achieves initiation of the switching sequence by a shock coming from any direction.

The annular magnet system is, in accordance with one embodiment example, placed into a radially-broadened cavity in the relay housing and is retained radially about its circumference by springs against the wall of the Housing recess or radially by springs on the inner side of the ring supported against the conduit of the contact arrangement and equidistant from the contact arrangement in its position of rest.

In another embodiment example, it is provided that the relay housing has a cavity running cylindrically co-axially with the longitudinal axis of the contact arrangement. The annular magnet system is anchored, movable horizontally, on both front faces of the cylindrical recess under spring load, by pairs of springs aligned mainly concentric with the longitudinal axis of the contact arrangement. The springs are equidistant from the contact arrangement in the position of rest.

A further embodiment example provides that the annular magnet system is arranged on the upper edge of a bearing cup whose outer diameter tapers conically downwards and whose small end is ball-shaped. The small end rests on a front face of the cylindrical cavity. The upper end is supported in the plane of the annular magnet system by springs about the upper edges circumference against the wall of the housing forming the cavity. The upper edge can also be supported on the inside of the ring magnet by springs positioned radially against the conduit of the contact arrangement, and equidistant from the contact arrangement in its position of rest.

Finally it is provided in a further embodiment example that the annular magnet is arranged on the larger diameter of a conical spring which is supported on one face of the housing forming the cavity. The conical spring is co-axial with the contact arrangement and has a smaller diameter surrounding one end of the contact arrangement or a corresponding mounting pin. The low-friction guidance of the annular magnet system enables the conical spring to position the annular magnet against the other face of the housing forming the cavity whereby the other faced is transverse of the longitudinal axis of the conical spring. The conical spring also holds the magnet system equidistant from the contact arrangement in its position of rest.

All embodiments have in common that shocks from any direction go through the annular magnet system to initiate the switching sequence, in which the annular magnet system consists of a ring magnet constructed from permanent magnet material or from several, preferably four, pemanent magnets arranged equally between two magnet-yoke forming iron rings.

The annular magnet system can consist of a ring formed from plastic whereby individual permanent magnets can be molded into the plastic, or the ring can consist of a plastic material enriched with powdered permanent magnet material.

In one embodiment, the bearing cup used for the support of the annular magnet can also be formed from plastic material enriched with powdered permanent magnet material, or can have molded in, on its upper edge, as an annular magnet, a corresponding number of permanent magnets arranged in a regular order. The bearing cup can, for example, be supported directly on one face of the cavity of the relay housing or by means of a central guide element and carry out the corresponding tumbler movement.

Other embodiment examples are naturally possible within the framework of this invention.

BRIEF DESCRIPTION OF THE SEVERAL VIEWS OF THE DRAWINGS

FIG. 4 is a sectional view of another embodiment example with an annular magnet system retained by springs on the faces of the housing recess.

FIG. 5 is a sectional view of a further embodiment example with an annular magnet system arranged on the upper edge of a bearing cup.

FIG. 6 is a plan view of an annular magnet system with individual magnets arranged in a ring.

FIG. 7 is a sectional view through a ring consisting of two iron rings with permanent magnets mounted between them as an annular magnet system.

DETAILED DESCRIPTION

Figure 1:
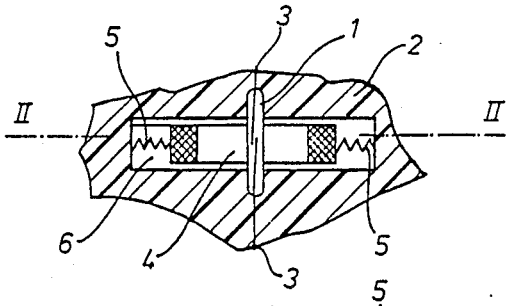
FIG. 1 is a sectional view of an embodiment example with an annular magnet system supported on the housing by springs on its circumference.

Illustrated schematically in FIG. 1 is a relay in accordance with the invention which consists of a housing (2) with a conduit or dry-reed contact arrangement (1) together with an annular magnet system (4) secured inside it. The conduit or dry-reed contact arrangement is a conventional hermetically sealed reed switch assembly. The magnet system (4) consisting of a permanently-magnetized ring has, in contrast to the diameer of the conduit or reed-contact (1), a much larger internal diameter and is movably mounted and guided in a horizontal cavity (6) defined by walls within the housing (2). The magnet ring of the magnet system (4) is supported radially by springs (5) mounted to the walls of the cavity (6).

Figure 2:
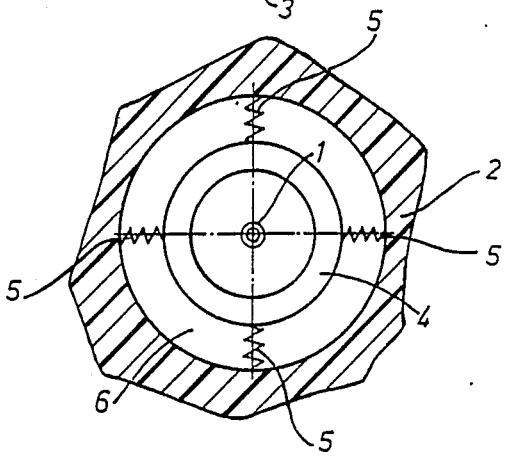
FIG. 2 is a schematic plan view of the embodiment example in FIG. 1.

The springs (5) are arranged evenly-distributed around the circumference of the magnet ring, as can be seen from FIG. 2.

Figure 3:
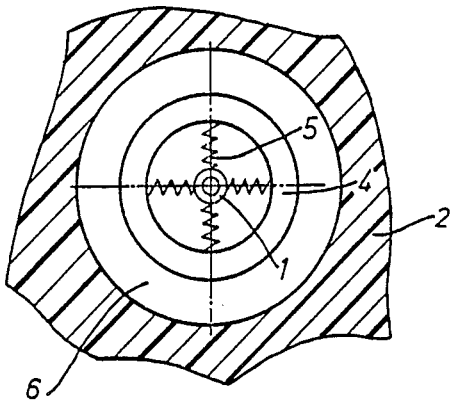
FIG. 3 is a schematic plan view of an embodiment example similar to that in FIG. 1 with an annular magnet system on the conduit of the contact arrangement supported by springs on its inner side.

FIG. 3, is a similar embodiment example to that in FIG. 1. However, the annular magnet system (4) shown supported on the conduit of the contact arrangement (1) by springs on its inner surface, wherein the annular magnet is positioned in a horizontal cavity (6) formed in the housing (2).

FIG. 4 shown an embodiment example which shows the magnet system (4) in a cylindrical cavity (6) running co-axially with the longitudinal axis of the contact arrangement (1). The annular magnet system (4) is anchored, and horizontally movable, on opposed walls (7) at each end of the cylindrical cavity (6) under spring load, by pairs of springs (5) aligned concentric with the longitudinal axis of the contact arrangement (1).

FIG. 5 shows, in section, a further embodiment example with the annular magnet system (4) arranged on the upper edge of a bearing cup (8). The bearing cup (8) is arranged likewise in a cylindrical cavity (6) formed in the housing (2). The cylindrical cavity is co-axial with the longitudinal axis of the contact arrangement (1). The bearing cup (8) tapers downwards from a larger diameter surrounding the annular magnet system (4) to a ball-shaped tapered end. The tapered end can be directly mounted on the wall (7) of the cylindrical cavity or be guided in its tumbler movement by a centralizing element. About the upper circumference of the bearing cup (8) in the plane of the magnet system (4), the bearing cup (8) is supported by springs (5) mounted on the walls of the cavity (6). In an alternative embodiment, the bearing cup (8) can also be supported on the conduit of the contact system (1) by springs (5) on its inner surface as shown in dashed lines in FIG. 5.

FIG. 6 shows a plan view of an annular magnet systems (4) which, for example, can consists of a ring formed from plastic (4*a*), into which individual permanent magnets (11), preferably four, are set.

Such a ring for the magnet systems (4) forms two magnet-yokes and can consist of two iron rings (12) between which individual permanent magnets (11) regularly distributed about its periphery are introduced, which can be seen in FIG. 7.

The embodiment examples of an annular magnet system shown in FIGS. 6 and 7 and here described are naturally useable for all embodiment examples of the relay, including that with the bearing cup (8) (FIG. 7).

Figure 8:
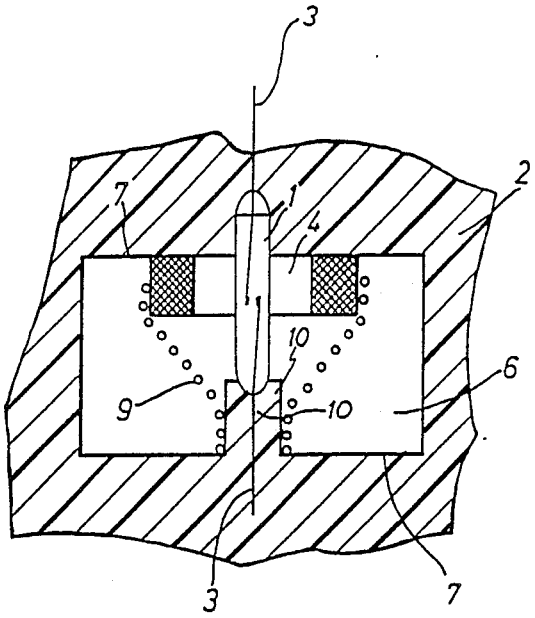
FIG. 8 is a further embodiment example with the annular magnet system arranged on the larger diameter of a conical spring.
Figure 8A:
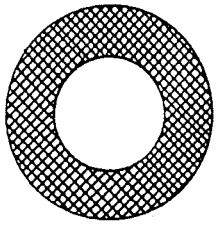
FIG. 8*a* illustrates in plan view a ring magnet constructed of permanent magnetic material and useful in the various embodiment of the invention.

In FIG. 8, a further embodiment example is shown, in which the annular magnet system (4) is arranged on the larger diameter of a conical spring (9) which is supported on one wall (7) of the cavity (6) formed in the housing (2). The conical spring (9) is co-axial with the contact arrangement (1) and has a smaller diameter surrounding one end of the conduit of the contact arrangement (1) or corresponding mounting pin (10). The cavity (6) is also co-axial with the longitudinal axis of the contact arrangement (1). FIG. 8*a* shows a top plan view of a ring magnet (11*a*) made entirely of permanent magnet material and may also be used in place of the magnet systems 4 above discussed.

Preferably the housing (2) of the relay according to the invention consists of plastic material which has smooth outer surfaces so that in the case of housing-side guidance or juxtaposition of the magnet system (4) the magnet system (4) can move freely. The contacts (3) of the contact system (1) are led out of the housing (2) in a suitable fashion and provided with connecting lugs (not illustrated).

What is claimed is:

1. A relay for the operation of a belt tightener or tensioner for automobile safety belts in the event of a collision with an obstacle, the relay comprising:

a housing having walls definingg a cavity therein;

a conduit or dry-reed contact arrangement mounted in the cavity defined by the housing, the conduit or dry-reed contact arrangement having a longitudinal axis which is perpendicular to the direction of travel of the automobile;

the conduit or dry-reed contact arrangement longitudinal axis is vertical to the horizontal plane of the automobile;

a magnet system mounted in the housing for initiating a switching sequence which operates the belt tightener or tensioner;

the magnet system including a permanent magnet which is primarily horizontally movable, the permanent magnet surrounding the conduit or dry-reed contact arrangement;

the permanent magnet is perpendicular to the conduit or dry-reed contact arrangement longitudinal axis; and spring means affixed to said permanent magnet and supported within said cavity for positioning said permanent magnet equidistant from the conduit or dry-reed contact arrangement when the permanent magnet is at rest.

2. The relay as defined in claim 1, wherein:

said cavity defines a longitudinal axis which is perpendicular to the conduit or dry-reed contact arrangement longitudinal axis;

the permanent magnet is annular; and the springs are mounted radially between the annular permanent magnets circumference and the walls.

3. The relay as defined in claim 1 wherein:

said cavity defines a longitudinal axis which is perpendicular to the conduit or dryreed contact arrangement longitudinal axis;

the permanent magnet is annular having a radially inner surface; and the springs are mounted radially between the permanent magnets inner surface and the conduit or dry-reed contact arrangement.

4. The relay as defined in claim 1 wherein said cavity is cylindrical and said walls defining said cavity include a first and second opposed walls and cavity is co-axial with the conduit or dry-reed contact arrangement longitudinal axis;

the permanent magnet is annular; and the springs are mounted between the annular permanent magnet and the first wall, and between the annular permanent magnet and the second wall, the springs being concentric with the conduit or dry-reed contact arrangement longitudinal axis.

5. The relay as defined in claim 1 wherein:

said walls define a cavity which is coaxial with the conduit or dry-reed contact arrangement longitudinal axis and which includes first and second opposed walls;

the relay further comprises a bearing cup having an upper edge and an outer surface tapering conically downward from the upper edge and resting on one of said opposed walls;

the permanent magnet is annular and is positioned on the bearing cup upper edge; and the springs are mounted between the annular permanent magnets circumference and said walls other than said opposed walls.

6. The relay as defined in claim 1 wherein:

said walls define a cavity which is coaxial with the conduit or dry-reed contact arrangement longitudinal axis and which includes first and second opposed walls;

the relay further comprises a bearing cup having an upper edge and an outer surface tapering conically downward from the upper edge and resting on one of said opposed walls;

the permanent magnet is annular having a radially inner surface, and is positioned on the bearing cup upper edge; and the springs are mounted between the annular permanent magnets inner surface and the conduit or dry-reed contact arrangement.

7. The relay as defined in claim 1, wherein:

said walls define a cavity which is coaxial with the conduit or dry-reed contact arrangement longitudinal axis;

the relay further comprises a conical spring having an upper large diameter and a lower small diameter, the spring being co-axial with the conduit or dry-reed contact arrangement;

the springs lower small diameter surrounds one end of the conduit or dry-reed contact arrangement; and the permanent magnet is annular and is positioned on the springs upper large diameter thereto biasing the annular permanent magnet against the opposed wall which is closest to the springs upper large diameter.

8. The relay as defined in claim 1, wherein:

said walls define a cavity which is coaxial with the conduit or dry-reed contact arrangement longitudinal axis and which includes first and second opposed walls;

the housing further includes a mounting pin extending from said first opposed wall;

the relay further comprises a conical spring having an upper large diameter and a lower small diameter, the spring being co-axial with the conduit or dry-reed contact arrangement;

the springs lower small diameter surrounds the mounting pin; and the permanent magnet is annular and is positioned on the springs upper large diameter thereby biasing the annular permanent magnet against said second opposed wall which is closest to the springs upper large diameter.

9. The relay as defined in claim 1 wherein the permanent magnet is a ring magnet consisting of permanently magnetized material.

10. The relay as defined in claim 2 wherein the annular permanent magnet is a ring magnet consisting of permanently magnetized material.

11. The relay as defined in claim 3 wherein the annular permanent magnet is a ring magnet consisting of permanently magnetized material.

12. The relay as defined in claim 4 wherein the annular permanent magnet is a ring magnet consisting of permanently magnetized material.

13. The relay as defined in claim 5 wherein the annular permanent magnet is a ring magnet consisting of permanently magnetized material.

14. The relay as defined in claim 6 wherein the annular permanent magnet is a ring magnet consisting of permanently magnetized material.

15. The relay as defined in claim 7 wherein the annular permanent magnet is a ring magnet consisting of permanently magnetized material.

16. The relay as defined in claim 8 wherein the annular permanent magnet is a ring magnet consisting of permanently magnetized material.

17. The relay as defined in claim 1 wherein the permanent magnet consists of four permanent magnets regularly mounted between two iron rings thereby forming two magnet-yokes.

18. The relay as defined in claim 2 wherein the annular permanent magnet consists of four permanent magnets regularly mounted between two iron rings thereby forming two magnet-yokes.

19. The relay as defined in claim 3 wherein the annular permanent magnet consists of four permanent magnets regularly mounted between two iron rings thereby forming two magnet-yokes.

20. The relay as defined in claim 4 wherein the annular permanent magnet consists of four permanent magnets regularly mounted between two iron rings thereby forming two magnet-yokes.

21. The relay as defined in claim 5 wherein the annular permanent magnet consists of four permanent magnets regularly mounted between two iron rings thereby forming two magnet-yokes.

22. The relay as defined in claim 6 wherein the annular permanent magnet consists of four permanent magnets regularly mounted between two iron rings thereby forming two magnet-yokes.

23. The relay as defined in claim 7 wherein the annular permanent magnet consists of four permanent magnets regularly mounted between two iron rings thereby forming two magnet-yokes.

24. The relay as defined in claim 8 wherein the annular permanent magnet consists of four permanent magnets regularly mounted between two iron rings thereby forming two magnet-yokes.

* * * * *